US005475882A

United States Patent [19]

Sereboff

[11] Patent Number: 5,475,882

[45] Date of Patent: Dec. 19, 1995

[54] GEL FILLED DEFORMABLE CUSHION AND COMPOSITION CONTAINED THEREIN

[76] Inventor: Joel L. Sereboff, 2215 Millridge Rd., Owings Mills, Md. 21117

[21] Appl. No.: 136,273

[22] Filed: Oct. 15, 1993

[51] Int. Cl.[6] ..... A61G 7/04

[52] U.S. Cl. ..... 3/450; 5/654; 5/644

[58] Field of Search ..... 5/499, 450, 654, 5/911, 644

[56] References Cited

U.S. PATENT DOCUMENTS

| | | | |
|---|---|---|---|
| 3,748,669 | 7/1973 | Warner | 5/450 |
| 3,968,530 | 7/1976 | Dyson | 5/450 X |
| 3,986,213 | 10/1976 | Lynch | 5/450 X |
| 4,588,229 | 5/1986 | Jay | 5/450 X |
| 4,728,551 | 3/1988 | Jay | 5/450 X |

*Primary Examiner*—Michael F. Trettel

*Attorney, Agent, or Firm*—Eckert Seamans Cherin & Mellott; Jolene W. Appleman; Arnold B. Silverman

[57] ABSTRACT

This invention provides for a gel filled deformable cushion (10) which includes a fluid impervious flexible enclosure (12) forming an internal chamber (14). Contained within the internal chamber (14) is a plasticizer composition (16) and a plurality of particulates (18) dispersed within the plasticizer composition (16). The particulates (18) are spherically contoured and have a density which is less than the density of the plasticizer composition (16) for increasing resiliency, deformability and memory of the overall composition within the cushion (10).

24 Claims, 1 Drawing Sheet

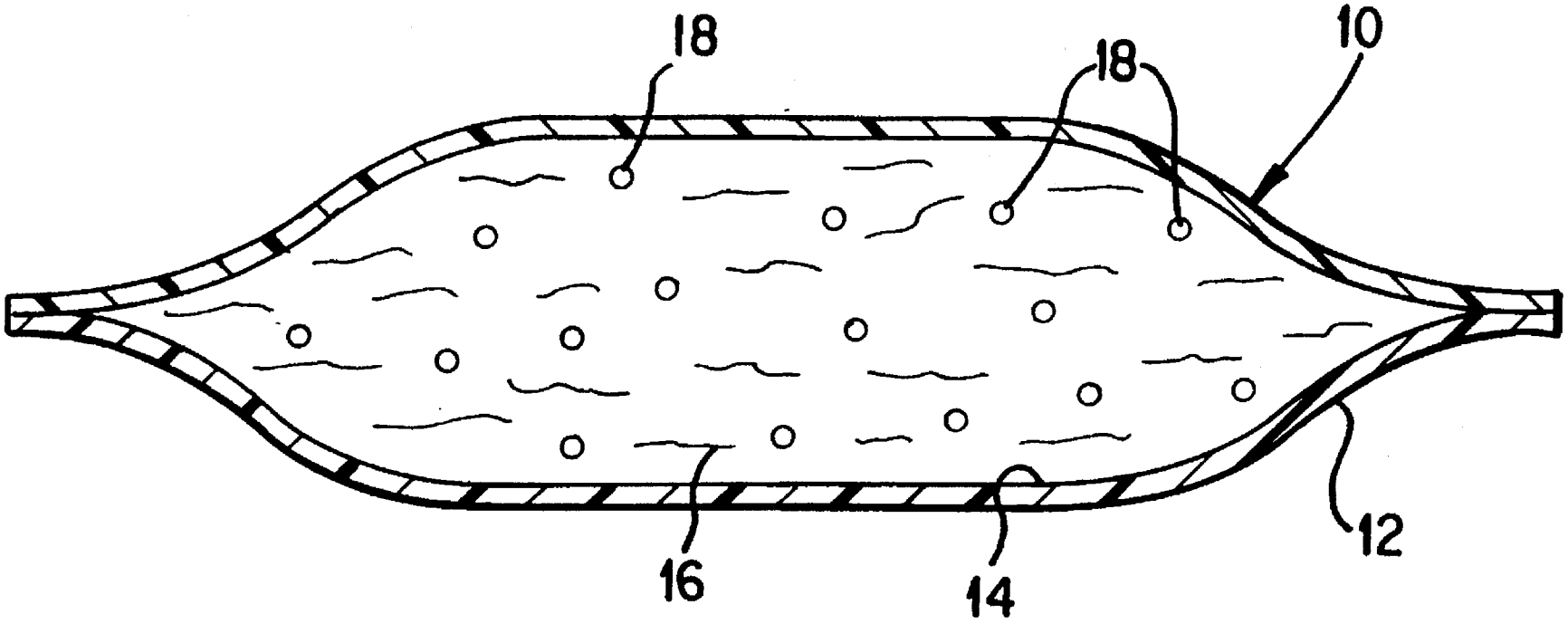
10
18
18
12
14
16

GEL FILLED DEFORMABLE CUSHION AND COMPOSITION CONTAINED THEREIN

BACKGROUND OF THE INVENTION

Field of the Invention

This invention directs itself to a gel filled deformable cushion and gel composition contained therein. Of great importance is that the invention relates to an ultra low density gel filled cushion which provides the user with an extremely low weight cushion which may be easily transported and/or manipulated by the user. In particular, this invention pertains to a deformable low density gel composition for use in a system undergoing force loading. More in particular, this invention directs itself to a gel composition for insert within a flexible cushion where the gel composition is formed of a plasticizer composition having a plurality of particulates dispersed therein. More in particular, this invention relates to a deformable low density gel composition defining a plasticizer composition in combination with substantially spherically contoured particulates dispersed therein forming a thixotropic type composition where a high viscosity is maintained under low shear conditions and a lowered viscosity under high shear. Still further, this invention directs itself to a deformable low density gel composition including both a plasticizer composition and a plurality of particulates with the particulates having a density less than the density of the plasticizer composition. Still further, this invention pertains to a low density gel composition that utilizes alkyl phthalate compositions as a plasticizer. Additionally, this invention relates to a deformable low density gel composition including a plurality of microsphere particulates dispersed within a plasticizer composition where the microsphere particulates have a diameter greater than 400 microns. Further, this invention directs itself to a fluid cushion which is deformable upon contiguous contact by a user's body and includes a deformable gel like composition therein which has a memory for reinstituting the original shape of the outer contour of the fluid cushion when relieved of a user's force loading. Additionally, this invention relates to a fluid cushion which includes a contained composition which is less flammable than commonly used mineral oils and which is of low weight, decreasing shipping weight costs.

PRIOR ART

Fluid filled cushions are known in the art. However, some prior art types of liquid filled or deformable cushions use water as a prime constituent of the fluid composition as described in prior art U.S. Pat. No. 5,100,712. However, the use of such water based types of fill compositions for cushions provides a system which is inordinately high in weight and increases the cost of transportability. Additionally, such prior art water-like systems have low deformation rates due to the non-compressibility of the water based liquids contained therein.

Other prior art systems and compositions for fluid cushions include mineral oil or alcohol liquids as provided in U.S. Pat. No. 5,093,138. However, such prior art systems and compositions suffer from the same type of disadvantages as described for the water based fluid cushion fillings. Additionally, such compositions although including spherical particles provide for spherical particle diameters of less than 300 microns, which has been found to be a detriment in the deformability characteristics of the subject invention system. Still further, such prior art systems provide a system which is more flammable than the subject invention concept and may provide disadvantages as to safety considerations in the advent of leakage of the internally contained composition.

Other prior art systems do not provide the ultra low density of the subject system, resulting in increased difficulties in overall use.

SUMMARY OF THE INVENTION

This invention provides for a deformable low density gel composition which includes a plasticizer composition having a first predetermined density value, Additionally, a plurality of particulates are dispersed within the plasticizer composition where the particulates are generally spherical in contour and include a second predetermined density which is less than the density of the plasticizer composition.

BRIEF DESCRIPTION OF THE DRAWING

The Figures shows in cross-section a gel filled deformable cushion having contained therein a plasticizer composition with dispersed particulates.

DESCRIPTION OF THE PREFERRED EMBODIMENTS

Referring now to the Figure, there is shown gel filled deformable cushion 10 having a fluid impervious flexible enclosure 12 forming a closed internal chamber 14.

In overall concept, cushion 10 is used for contiguous interface with a user's body to disperse force loading over a wider area to lower stress applied and increase the comfort level of the user. Additionally, and in combination with the aforementioned concept, cushion 10 must be formed in a manner to provide an ultra low density system resulting in an optimized low weight cushion 10. Cushion 10 must be adaptable to a wide range of external environmental conditions since it may be used in any environment chosen by the ultimate user.

The development of the subject combination of cushion 10 and composition contained therein has taken into account a wide variety of concatenating parameters which include optimization of weight, safety in the form of composition flammability, deformability and flexibility as well as memory of the cushion 10.

Internal chamber 14 is substantially filled with plasticizer composition 16 having dispersed therein a plurality of substantially spherically contoured particulates 18 with the important physical parameter criteria that particulates 18 have a lower density than plasticizer composition 16.

The combined plasticizer composition 16 and spherically contoured particulates 18 are formed into a gel like overall composition which is maintained within the fluid tight enclosure 12. The gel like composition as herein described in following paragraphs is particularly adapted for compression by portions of a user's body.

Deformable cushion 10 disperses the forces applied by a user's body over a wide area to lower stress and to disperse the applied forces over a wider area of the body, thus lowering the force loading per unit area in the areas of contact between the user's body and cushion 10. There are certain areas of the human body which when contacting the cushion 10 are somewhat like point loading areas such as bony areas of the human body. Particularly, although not directed specifically to this anatomical feature, the ischium of a person is one of three parts of the hip bone which joins the ilium and the pubis to form the acetabulum. The ischium includes the dorsal portion of the hip bone and is divided into the body of the ischium which forms two-fifths of the acetabulum and the ramus which joins the inferior ramus of the pubis. The spine of the ischium provides attachment for a multiplicity of muscles such as the gemellus superior, the coccygeus, and the levitator ani. Illustrative of the point loading are the ischial spines which are relatively sharp bony projections into the pelvic outlet from the ischial bones that form the lower border of the pelvis. Particularly, it is of importance that these sharp bony projections when in contiguous contact with cushion 10 create forces which are dispersed over a wider area to optimize comfort of the person interfacing with cushion 10.

The particular cushion 10 and composition contained therein as herein described have been conceived for the specific purpose of optimizing the comfort of the user. Cushion 10 may be used as a seat member for a chair, a back rest, or even inserted within a fluid containment device such as a bathtub for positional stabilization of a person to increase the comfort level of the user. The ultra low density and resulting low weight of cushion 10 allows the user to transport cushion 10 from one environment to another in a simple manner.

The particular gel composition as herein described has certain characteristics which are particularly directed to optimization of comfort and usage by a user. Of importance is the fact that any fluid containment device which must be transported from one area to another should have a low weight in order to allow transportability of the overall cushion system by a user. Liquids such as water have relatively high densities which increase the overall weight of cushion 10. Thus, compositions having a relatively high density could not be used as the gel composition of the subject invention system. Therefore, the final gel composition for cushion 10 had a basic criteria of having a relatively low density. Additionally, in order to provide this low density type system it was found that both a plasticizer composition in combination with particulates have a great optimizing effect with regard to weight as well as to deformation characteristics as will be further described, Of importance is the fact that the overall composition have a deformable contour in order to allow contiguous mating with differing contours of a user's body which contact the cushion 10. Further, the overall gel composition must include a memory which allows the outer contour or enclosure 12 to return to an initial shape subsequent to being force loaded.

The deformable low density gel composition as herein will be described is particularly adaptable to fluid cushions such as those shown and described in U.S. Pat. No. 5,113,540 having common inventorship with the subject composition system. Initially, water was used as the liquid composition to fill cushion 10 however, it was found that such provided an unacceptable high weight which was unacceptable for transportability purposes.

Plasticizer compositions were chosen as the composition within cushion 10. However, such was not found to have sufficient resiliency nor memory in use as a body engaging or interfacing cushion. Surprisingly, it was found that by inserting a quantity of spherically contoured particulates within the plasticizer composition of a preferred size, that the resiliency of the overall mixture increased dramatically over the mere use of the plasticizer composition. Additionally, when particulates were used which had a density greater than the density of the plasticizer composition, the resiliency and memory of the overall cushion 10 was once again diminished. It was thus discovered that the resiliency of the overall cushion 10 increased as a function of the relative densities of the plasticizer composition and the particulates dispersed therein. Although it is not known the exact process by which the resiliency is increased when the density of the particulates is less than the plasticizer composition it is believed that the particulates actually deform under loading and when relieved of the loading provide for a restoring type force to the plasticizer composition. Additionally, it is believed that the lower density of the particulates allows the particulates to maintain a more homogeneous mixture with the plasticizer composition over an extended period of time.

Plasticizers are generally small organic molecules that act as lubricants between chains and are generally added to plastics to keep them from becoming brittle at room temperatures. Such plasticizers as may be useful in the subject composition must be relatively non-volatile liquids which are blended with polymers to alter their properties by intrusion between the polymer chains. The particular plasticizer used in the subject composition is generally colorless and was chosen from the phthalate ester chemical family. In particular this is an alkyl phthalate and further in particular diisononyl phthalate was chosen as the plasticizer which provided for the appropriate physical parameters necessary. The plasticizer composition generally has a specific gravity approximating 0.97 with a density range approximating 0.8–1.2 gm/cc. Different batches of the plasticizer compositions depicted a range of densities, however final plasticizers used in the subject composition approximated 1.0 gm/cc. The particular plasticizer composition successfully used in the subject cushion 10 is 1,2 benzenedicarboxylic acid, di-C8-10 br alkyl ester. This is sold under the product name of JAYFLEX DINP by Exxon Chemical Americas, a division of Exxon Chemical Company having a business address in Houston, Tex.

In addition to the physical parameters necessary, the plasticizer composition was chosen for the fact that it will be used in a wide range of environments by a user and in the event that such egresses from the enclosure 12, such must have minimal toxicity with substantially no inhalation hazard at ambient temperatures and if it comes into skin contact such must exhibit a low order of toxicity.

Normally, the plasticizer composition chosen is only inflammable upon heating to temperatures at or above the Flash point which is approximately 415° F.

Thus, one of the important points for the particular plasticizer composition being used is that the overall composition may come in contact with the user with minimal toxicity and may be used over a wide variety of environmental conditions with minimal hazard to the user under normal operating conditions.

Once the plasticizer composition was found which would meet environmental considerations, it was further found that densities had to be reduced in order to maintain a low weight. Incorporation of ceramic microspheres produced by PQ Corporation under the trademark EXTENDOSPHERES CG CERAMIC MICROSPHERES was of advantageous use in lowering the overall weight. The ceramic microspheres contain up to approximately 5% crystalline silica, mullite and glass and is a non-combustible composition. The overall bulk density approximates 0.4 g/cc and was found to be of use with spherical microsphere contours having a diameter greater than 400 microns. When dispersed within the plasticizer composition, it was found that diameters less than 400 microns provided a system whereby the resiliency and memory of the overall composition was affected when used in the Flexible enclosure 12 of the cushion 10.

Plastic microspheres having a density approximating 0.022 gm/cc were also found to be of advantageous use in the gel composition. The plastic microspheres are also produced by PQ Corporation having a business address at 11 Executive Hall, Valley Forge, Pa. and include the model designation PM6545. Such plastic microspheres when dispersed within the plasticizer composition as hereinbefore described provided For a very low weight cushion 10 while providing increased resiliency and deformability even over the ceramic microspheres previously discussed. Once again, spherical diameters of greater than 400 microns was found to be of significant advantage when deformability and resiliency were taken into account.

Although the process is not known by the inventor, it is believed that the surface area of the plastic microspheres must be of a sufficient amount to allow some type of deformation upon force loading and thus aids in the resiliency of the overall system.

When comfort of the user was measured, the approximate weight percentages of the various constituents included approximately 80% of plasticizer composition to approximately 20% of the microsphere particulates. This was a subjective type of testing wherein users were essentially tested varying compositional weight percentages and it was subjectively determined that the aforementioned weight percentage ratio optimized the comfort level of a majority of users.

The range of the spherical diameters for particulates used ranged between 400 and 600 microns. The resiliency, deformability and comfort did not seem to be affected in this range. The only noticeable disadvantages, as before described, occurred when the diameters were lowered below 400 microns.

Additional advantages of using the microspheres whether ceramic or plastic as hereinbefore described was the fact that once the microspheres were blended with the plasticizer composition that such substantially maintained a homogeneity during extended use times. Thus, there was not found to be any congealing or agglomeration of particulates in a particular area of the cushion 10.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A deformable low density gel composition comprising:

(a) a plasticizer composition having a first predetermined density;

(b) a plurality of particulates dispersed within said plasticizer composition, said particulates being substantially spherical in contour and having a second predetermined density less than said first predetermined density of said plasticizer composition; and (c) said gel composition has about 80% by weight of said plasticizer composition to about 20% by weight of said plurality of particulates.

2. The deformable low density gel composition as recited in claim 1 where said plasticizer composition is an alkyl phthalate composition.

3. The deformable low density gel composition as recited in claim 2 where said alkyl phthalate composition is diisononyl phthalate.

4. The deformable low density gel composition as recited in claim 2 where said alkyl phthalate composition includes a density approximating 1.0 gm/cc.

5. The deformable low density gel composition as recited in claim 1 where said particulates dispersed within said plasticizer composition are formed of a plastic composition.

6. The deformable low density gel composition as recited in claim 5 where said particulates are plastic microspheres having a diameter greater than 400 microns.

7. The deformable low density gel composition as recited in claim 6 where said plastic microspheres have a density approximating 0.022 gm/cc.

8. The deformable low density gel composition as recited in claim 1 where said particulates dispersed within said plasticizer composition are formed of ceramic composition microspheres.

9. The deformable low density gel composition as recited in claim 8 where said ceramic composition microspheres include a diameter greater than 400 microns.

10. The deformable low density gel composition as recited in claim 8 where said ceramic composition microspheres have a density approximating 0.7 gm/cc.

11. A gel filled deformable cushion comprising:

(a) a fluid impervious flexible enclosure forming an internal chamber;

(b) a plasticizer composition within said internal chamber having a first predetermined density;

(c) a plurality of particulates dispersed within said plasticizer composition, said particulates being substantially spherical in contour and having a second predetermined density less than said first predetermined density of said plasticizer composition; and (d) said gel composition has about 80% by weight of said plasticizer composition to about 20% by weight of said plurality of particulates.

12. The gel filled deformable cushion as recited in claim 11 where said spherically contoured particulates are selected from the group consisting of plastic composition microspheres, ceramic composition microspheres and combinations thereof.

13. The gel filled deformable cushion as recited in claim 12 where said plastic composition microspheres include a density approximating 0.022 gm/cc.

14. The gel filled deformable cushion as recited in claim 12 where said ceramic composition microspheres include a density approximating 0.7 gm/cc.

15. The gel filled deformable cushion as recited in claim 12 where said spherically contoured particulates include a spherical diameter greater than 400 microns.

16. The gel filled deformable cushion as recited in claim 12 where said plasticizer composition includes a density within the approximating range of 0.8 to 1.2 gm/cc.

17. The gel filled deformable cushion as recited in claim 12 where said plasticizer composition includes a density approximating 1.0 gm/cc.

18. The gel filled deformable cushion as recited in claim 16 where said plasticizer composition is an alkyl phthalate composition.

19. The gel filled deformable cushion as recited in claim 16 where said plasticizer composition is diisononyl phthalate.

20. A deformable low density gel composition comprising:

(a) a plasticizer composition having a first predetermined density; and (b) a plurality of particulates dispersed within said plasticizer composition, said particulates being substantially spherical in contour and having a second predetermined density less than said first predetermined density of said plasticizer composition; and (c) said plasticizer composition is an alkylphthalate composition.

21. The deformable low density gel composition as recited in claim 20 where said alkylphthalate composition is diisononylphthalate.

22. The deformable low density gel composition as recited in claim 20 where said alkylphthalate composition includes a density approximating 1.0 gm/cc.

23. A gel filled deformable cushion comprising:

(a) a fluid impervious flexible enclosure forming an internal chamber;

(b) a plasticizer composition within said internal chamber having a first predetermined density; and (c) a plurality of particulates dispersed within said plasticizer composition, said particulates being substantially spherical in contour and having a second predetermined density less than said first predetermined density of said plasticizer composition; and (d) said plasticizer composition is an alkylphthalate composition.

24. The gel filled deformable cushion as recited in claim 23, where said plasticizer composition is diisononylphthalate.

* * * * *